US006006404A

United States Patent [19]

Sun

[11] Patent Number: 6,006,404

[45] Date of Patent: Dec. 28, 1999

[54] RETROREFLECTIVE BUTTON

[76] Inventor: Chih-Kuo Sun, Rm 4G-25, No. 5, Hsin-Yi Road, Sec. 5, Taipei, Taiwan

[21] Appl. No.: 09/248,531

[22] Filed: Feb. 10, 1999

[30] Foreign Application Priority Data

Mar. 18, 1998 [TW] Taiwan ..... 87203969

[51] Int. Cl.[6] ..... A44B 1/00; A44B 17/00

[52] U.S. Cl. ..... 24/114.9; 24/90.1

[58] Field of Search ..... 24/114.9, 90.1

[56] References Cited

U.S. PATENT DOCUMENTS

| | | | |
|---|---|---|---|
| 513,312 | 1/1894 | Esser | 24/114.9 |
| 2,214,030 | 9/1940 | Pereles | 24/114.9 |
| 2,568,212 | 9/1951 | Backman | 24/114.9 |
| 2,596,965 | 5/1952 | Troy | 24/114.9 |
| 2,983,975 | 5/1961 | Hubbell | 24/114.9 |
| 3,087,215 | 4/1963 | Tworek et al. | 24/114.9 |
| 3,439,439 | 4/1969 | Stimson | 24/114.9 |

FOREIGN PATENT DOCUMENTS

| | | | |
|---|---|---|---|
| 1030058 | 6/1953 | France | 24/114.9 |

*Primary Examiner*—Victor N. Sakran

[57] ABSTRACT

A retroreflective button includes: a front mirror surface formed on a front surface of the button, a plurality of micro prisms each being polygonal shape and capable of transmitting and reflecting light from the polyhedral facets of each micro prism for retroreflecting an incoming light as emitted from a light or illuminating source for warning and optical decorative purposes, and a fastening device formed on a rear portion of each button to be secured on a wearer's garment or the like.

6 Claims, 3 Drawing Sheets

RETROREFLECTIVE BUTTON

BACKGROUND OF THE INVENTION

A conventional button attached to a garment is provided for fastening two surfaces together by passing it through a button hole or loop. However, a conventional button is not retroreflective and thereby lacking of optical warning effect on a traffic safety viewpoint.

The present inventor has found the drawbacks of a conventional button and invented the present retroreflective button.

SUMMARY OF THE INVENTION

The object of the present invention is to provide a retroreflective button including: a front mirror surface formed on a front surface of the button, a plurality of micro prisms each being polygonal shape and capable of transmitting and reflecting light from the polyhedral facets of each micro prism for retroreflecting an incoming light as emitted from a light or illuminating source for warning and optical decorative purposes, and a fastening device formed on a rear portion of each button to be secured on a wearer's garment or the like.

DETAILED DESCRIPTION

Figure 1:
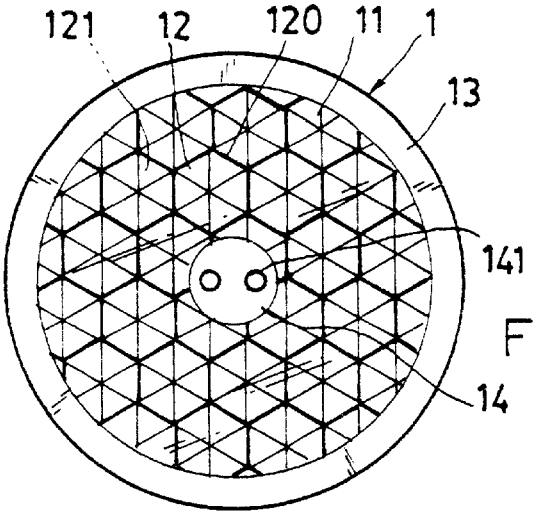
FIG. 1 is a front view of the present invention.
Figure 2:
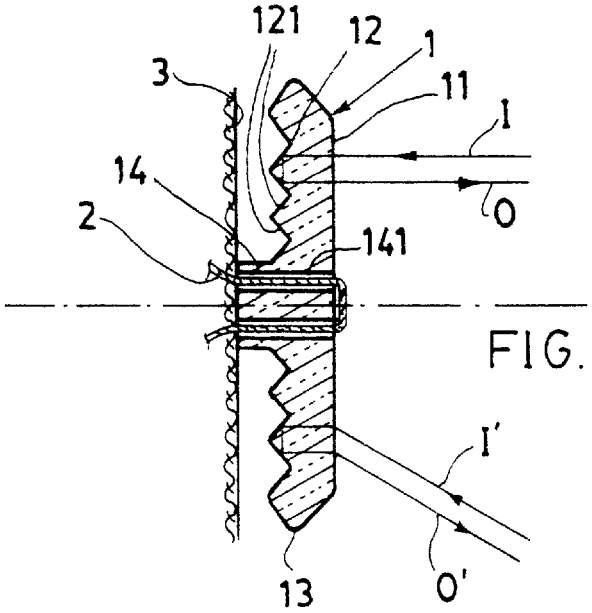
FIG. 2 is a side-view sectional drawing of the present invention.
Figure 3:
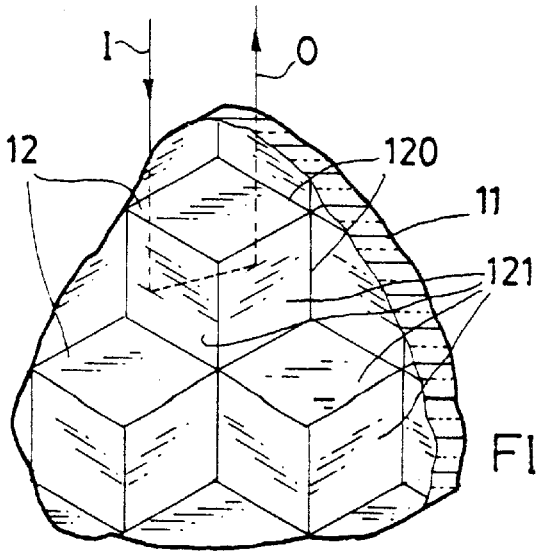
FIG. 3 is a rear perspective view of the micro prisms of the present invention.

As shown in FIGS. 1~3, the retroreflective button 1 of the present invention comprises: a front mirror surface 11 formed on a front surface of the button 1, a plurality of micro prisms 12 integrally formed on a rear portion of the button 1, a periphery 13 circumferentially formed on an edge portion of the button having a cross section of arcuate shape for an easy passing through a button hole or a loop of a garment or the like, and a fastening portion 14 formed on a rear portion of the button I to be secured on a garment 3 such as by fastening a thread 2 passing through the thread holes or fastening holes 141 formed through the fastening portion 14.

Each micro prism 12 includes a front polygonal (such as a hexagonal) base 120 coplanar with the front mirror surface 11 of the button 1, and a plurality of polygonal (such as square) facets 121 formed on a rear portion of the micro prism 12, whereby upon entrance of an incoming light (I) through the front mirror surface 11, the light will be inwardly transmitted through the front mirror surface 11 and then reflected by plural facets 121 of the micro prism 12 for retroreflecting the incoming light outwardly and backwardly for optical warning purpose.

Each facet 121 of the micro prism 12 is formed with a rear mirror surface on its rear surface for reflecting the incoming light backwardly.

Each micro prism 12 is made of light transmissive or transparent for transmitting and reflecting the light. It may be made of transparent plastic materials having pigments incorporated therein for forming colorful button for better optical warning and decorative purposes.

The fastening portion 14 may be a stem formed on a rear central portion of the button I to be secured on a wearer's garment, coat, cap or the like.

The incoming light (I) may be transmitted into the micro prisms 12 and doubly reflected for retroreflecting the light outwardly (0) for optical warning and ornamental purposes.

If the incoming light (I') is inclinedly refracted into the button I of the present invention as shown in FIG. 2, the outgoing light (O') will then be retroreflected outwardly for optical warning purpose.

Figure 4:
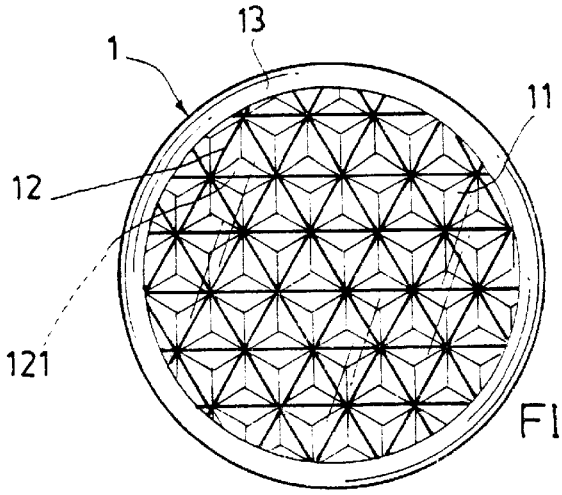
FIG. 4 is a front view of another preferred embodiment of the present invention.
Figure 5:
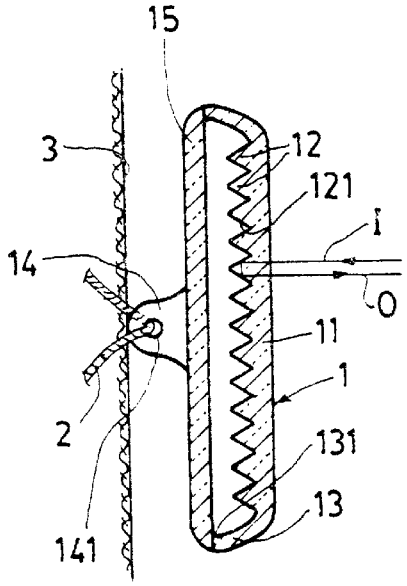
FIG. 5 is a side-view sectional drawing of the present invention of FIG. 4.
Figure 6:
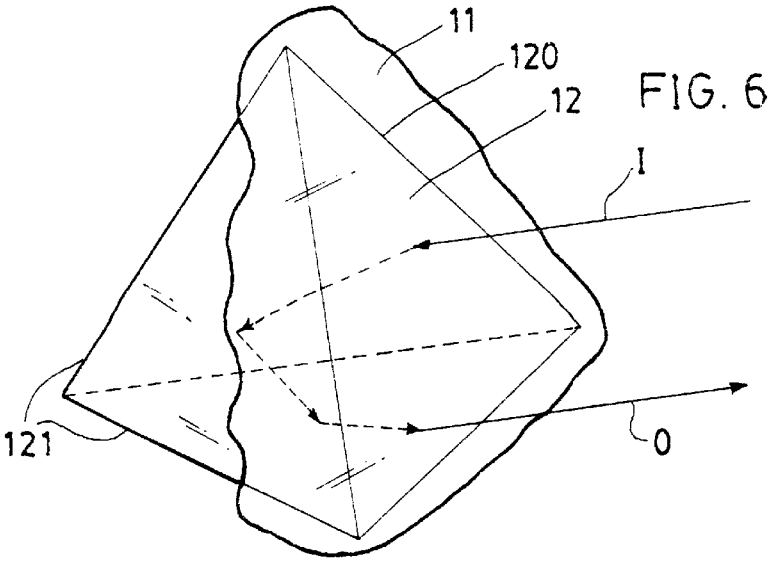
FIG. 6 is a rear perspective view of the micro prim of the present invention of FIG. 4.

Another preferned embodiment of the present invention is shown in FIGS. 4~6, in which each micro prism 12 is formed as a pyramid having a front triangular base 120 coplanar with the front mirror surface 11 of the button 1, and a plurality of triangular facets 121 formed on a rear portion of the micro prism 12; and the fastening portion 14 is protruded rearwardly from a bottom plate 15 which is secured, adhered, combined or integrally formed with a rear rim 131 of the periphery 13 of the button 1, having a fastening hole or thread hole 141 formed through the fastening portion 14, whereby upon fastening of a thread 2 through the hole 141 into a garment 3, the button 1 will be secured on the wearer's garment 3 for safety warning purpose. The incoming light (I) will be transmitted and reflected in the micro prism 12 of pyramid as shown in FIG. 6 for retroreflecting light outwardly (O) for optical warning purpose.

Figure 7:
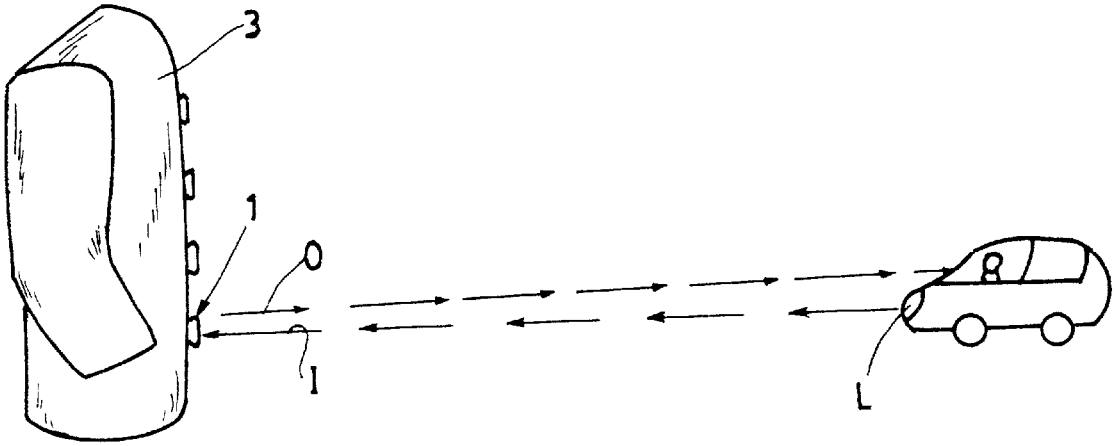
FIG. 7 is an illustration showing the retroreflection as effected by the present invention.

The present invention provides an optically brightening button 1 for retroreflecting a light beam, as projected from a light source such as emitted by a spot light L of a driving car, backwardly towards the light source such as towards the driver's eyes for warning for enhancing traffic safety as shown in FIG. 7. Meanwhile, the present invention may also provide brightening or shining buttons for enhancing optical ornamental effect.

The shapes, structure, construction and materials for making the button of the present invention are not limited. The present invention may be modified without departing from the spirit and scope of the present invention. The fastening portion 14 may be substituted with a metal nail or the like to be secured on a wearer's garment or the like.

I claim:

1. A retroreflective button comprising:

a front mirror surface formed on a front surface of the button;

a plurality of micro prisms integrally formed on a rear portion of the button, each said micro prism having a polygonal base coplanar with the front mirror surface of the button for transmitting incoming light inwardly into each said micro prism through said base, and a plurality of polygonal facets formed on a rear portion of the micro prism, each said facet having a rear mirror surface formed on a rear surface of said facet for reflecting the incoming light backwardly, each said micro prism transmitting and reflecting an incoming light as emitted from a light source through said front mirror surface and said plurality of polygonal facets for retroreflecting the incoming light outwardly backwardly towards the light source; and a fastening portion formed on a rear portion of the button to be secured on a wearer's garment or the like.

2. A retroreflective button according to claim 1, wherein said button includes a periphery having a cross section of arcuate shape circumferentially formed on an edge portion of the button.

3. A retroreflective button according to claim 1, wherein said fastening portion is formed on a central portion of said button, having at least a fastening hole formed through said fastening portion for fastening a thread through said fastening hole to a garment for securing said button on the garment.

4. A retroreflective button according to claim 1, wherein said fastening portion includes a stem protruded rearwardly from a bottom of said button, said stem having a fastening hole formed therethrough for passing a thread through said fastening hole for fastening said button on a garment.

5. A retroreflective button according to claim 1, wherein each said micro prism is a pyramid.

6. A retroreflective button according to claim 1, wherein said polygonal base is a hexagonal base and each said polygonal facet is a square facet.

* * * * *